US006595804B2

(12) United States Patent
Nagata

(10) Patent No.: US 6,595,804 B2
(45) Date of Patent: Jul. 22, 2003

(54) MULTIPOLAR JACK, A MULTIPOLAR PLUG, AND A STRUCTURE FOR CONNECTING A MULTIPOLAR JACK WITH A MULTIPOLAR PLUG

(75) Inventor: Takayuki Nagata, Higashiosaka (JP)

(73) Assignee: Hosiden Corporation, Osaka-fu (JP)

( * ) Notice: Subject to any disclaimer, the term of this patent is extended or adjusted under 35 U.S.C. 154(b) by 0 days.

(21) Appl. No.: 09/886,016

(22) Filed: Jun. 22, 2001

(65) Prior Publication Data

US 2002/0052148 A1 May 2, 2002

(30) Foreign Application Priority Data

Oct. 30, 2000 (JP) ..... 2000-330159

(51) Int. Cl.[7] ..... H01R 17/18
(52) U.S. Cl. ..... 439/668; 439/675; 439/669
(58) Field of Search ..... 439/668, 79, 947, 439/108, 188, 339, 669, 675

(56) References Cited

U.S. PATENT DOCUMENTS 6,220,899 B1 * 4/2001 Suzuki ..... 439/675
6,270,380 B1 * 8/2001 Shichida et al. ..... 439/669

FOREIGN PATENT DOCUMENTS

| | | |
|---|---|---|
| JP | 8-138807 | 5/1996 |
| JP | 2548613 | 5/1997 |
| JP | 10-335010 | 12/1998 |
| JP | 2875617 | 1/1999 |

* cited by examiner

*Primary Examiner*—P. Austin Bradley
*Assistant Examiner*—Phuongchi Nguyen
(74) *Attorney, Agent, or Firm*—Jones, Tullar & Cooper, P.C.

(57) ABSTRACT

In the invention, when two electrodes are added by using the cylindrical portion of the body, the two additional electrodes are prevented from being short-circuited when the multipolar plug P having an annular electrode in the root portion of the shaft is connected to the jack. Four main electrodes of the shaft of the plug are in contact with four main electrodes inside the body of the jack, respectively. First and second additional electrodes are respectively placed on lateral sides of the cylindrical portion of the jack and are positionally shifted in the longitudinal and radial directions. First and second annular electrodes are concentrically disposed on a basal portion of the plug.

13 Claims, 7 Drawing Sheets

MULTIPOLAR JACK, A MULTIPOLAR PLUG, AND A STRUCTURE FOR CONNECTING A MULTIPOLAR JACK WITH A MULTIPOLAR PLUG

BACKGROUND OF THE INVENTION

1. Field of the Invention

The present invention relates to a multipolar jack, a multipolar plug, and a structure for connecting a multipolar jack with a multipolar plug, and more particularly to a multipolar jack having a configuration in which the number of electrodes is increased by using a cylindrical portion formed on the body, a multipolar plug in which the number of electrodes is increased by using a root portion of a shaft, and a structure for connecting such a multipolar jack with such a multipolar plug.

2. Description of the Prior Art

Japanese Patent No. 2,875,617 discloses a conventional multipolar jack, and a single-head multipolar plug which serves as a counter member for the jack. The multipolar jack disclosed in the patent has four electrodes which form four electrodes inside the body. A stationary electrode which is a fifth electrode and called a mouthpiece is annularly attached to the outer periphery of a cylindrical portion of the body. A movable electrode which is a sixth electrode and elastically deformable is placed outside the stationary electrode while being separated therefrom. The multipolar plug which serves as a counter member for the multipolar jack has: a shaft comprising four contacts which are to be respectively in contact with the four electrodes of the multipolar jack; and, outside the root portion of the shaft and concentrically with the root portion, two annular connecting terminals which form fifth and sixth electrodes. The two or fifth and sixth connecting terminals are in contact with the fifth or stationary electrode and the sixth or movable electrode of the multipolar jack, respectively.

Japanese Laid-Open Patent Application No. 8-138807 discloses another conventional multipolar jack, and a single-head multipolar plug which serves as a counter member for the jack. The multipolar jack disclosed in the publication has two electrodes in two places of an outer peripheral portion of a sleeve. The multipolar plug which serves as a counter member for the multipolar jack has two annular contacts outside the root portion of a shaft and concentrically with the root portion.

Japanese Laid-Open Patent Application No. 10-335010 and Japanese Utility Model Registration No. 2,548,613 also describe a multipolar jack, a multipolar plug, etc.

In the multipolar jack disclosed in Japanese Patent No. 2,875,617, the stationary electrode which is the fifth electrode is attached to the outer periphery of the cylindrical portion formed on the body, and the movable electrode which is the sixth electrode is placed outside the stationary electrode. Therefore, the multipolar jack has a problem in that, when a five-electrode plug in which four electrodes are disposed on a shaft and a fifth or annular stationary electrode is disposed in a root portion of the shaft is connected to the multipolar jack, for example, the inner and outer faces of the fifth electrode or stationary electrode of the multipolar plug are in contact with both the stationary and movable electrodes of the multipolar jack, so that the stationary and movable electrodes may be short-circuited.

Also the multipolar jack disclosed in Japanese Laid-Open Patent Application No. 8-138807 has a problem in that, when a five-electrode plug in which four electrodes are disposed on a shaft and a fifth or annular stationary electrode is disposed in a root portion of the shaft is connected to the multipolar jack, for example, two places of the inner face of the fifth electrode or stationary electrode of the multipolar plug are in contact with two electrodes of an outer peripheral portion of a sleeve of the multipolar jack, so that the electrodes may be short-circuited.

SUMMARY OF THE INVENTION

It is an object of the present invention to provide a multipolar jack in which, in the case where two electrodes are added by using a cylindrical portion formed on the body of the multipolar jack, even when a multipolar plug having an annular electrode in a root portion of a shaft as described above is connected to the jack, the two electrodes which are added by using the cylindrical portion are not short-circuited by the annular electrode of the multipolar plug.

The present invention provides a multipolar jack having: a body; a body main portion which is formed integrally with the body; a cylindrical portion which protrudes outwardly from the body main portion; and a plurality of main electrodes which are disposed inside the body, and which are to be electrically connected to a plurality of main electrodes that are longitudinally arranged on a shaft of a multipolar plug, respectively, the multipolar plug being inserted through the cylindrical portion to a position concentrical with or substantially concentrical with the cylindrical portion, wherein the multipolar jack comprises: a large-diameter portion which is present on a side of a basal portion forming the cylindrical portion; a small-diameter portion which protrudes from a front end of the large-diameter portion; a step which is stepwise formed in a boundary between the large-diameter portion and the small-diameter portion; a first additional electrode which is placed outside the large-diameter portion, and in which a contact is positioned in the rear of the step and to be in contact with a contact on a side of an inner face of a first annular electrode disposed in a periphery of the shaft of the multipolar plug; and a second additional electrode which is placed outside the small-diameter portion, and in which a contact is positioned in front of the step and for contact with a contact on a side of an inner face of a second annular electrode concentrically disposed in a periphery of the shaft of the multipolar plug and inside the first annular electrode.

In the multipolar jack of the present invention, the distance from an axis of the cylindrical portion to the contact of the first additional electrode is longer than the distance from the axis of the cylindrical portion to the contact of the second additional electrode.

In the thus configured multipolar jack, even when a multipolar plug comprising an annular electrode (fifth electrode) in a root portion of a shaft is connected to the jack, a situation where the annular electrode is in contact with the two or first and second additional electrodes which are added by using the cylindrical portion and the two additional electrodes are short-circuited never occurs.

In the multipolar jack of the present invention, the contact of the first additional electrode is in contact with the contact on the side of the inner face of the first annular electrode disposed in a periphery of the shaft of the multipolar plug, and the contact of the second additional electrode is in contact with the contact on the side of the inner face of the second annular electrode concentrically disposed in a periphery of the shaft of the multipolar plug and inside the first annular electrode. Therefore, a multipolar plug having electrodes the number of which is equal to that of the multipolar jack can be connected to the multipolar jack.

Particularly, it is preferable to set a tip end of the first additional electrode to be positioned in the rear of the step. According to this configuration, in the case where a shaft of a multipolar plug which comprises an annular electrode (fifth electrode) in a root portion of the shaft and in which the annular electrode has an inner periphery diameter that allows the annular electrode to be fitted onto the small-diameter portion of the cylindrical portion and not to be fitted onto the large-diameter portion is inserted into the body, the annular electrode of the multipolar plug is simply inserted until the electrode abuts against the tip end of the large-diameter portion of the multipolar jack, i.e., until the electrode abuts against the step portion of the multipolar jack. Therefore, a situation where the annular electrode is in contact with the first additional electrode of the multipolar jack never occurs. Consequently, a situation does not occur where the two or first and second additional electrodes of the multipolar jack are in contact with the single annular electrode of the multipolar plug and the additional electrodes are short-circuited.

In the multipolar jack of the present invention, preferably, an outer periphery diameter of the large-diameter portion is shorter than the inner periphery diameter of the first annular electrode of the multipolar plug and larger than the inner periphery diameter of the second annular electrode, and an outer periphery diameter of the small-diameter portion is shorter than the inner periphery diameter of the second annular electrode.

In the multipolar jack of the present invention, preferably, the body main portion has a rectangular parallelepiped outer shape which extends to both lateral sides of the cylindrical portion, the first and second additional electrodes are placed on lateral sides of the cylindrical portion, and a first additional electrode attachment piece which is formed by rearward elongating the first additional electrode, and a second additional electrode attachment piece which is formed by rearward elongating the second additional electrode are fixed in both sides of the cylindrical portion to the body main portion, respectively. According to this configuration, the two or first and second additional electrodes can be attached by using the body main portion 11 which extends to the lateral sides of the cylindrical portion. Therefore, a situation where places to which the electrodes are attached protrude outside the body does not occur. This is useful for preventing an increase in the size of the multipolar jack.

In the multipolar jack of the present invention, a configuration can be employed in which four electrodes are formed by the plurality of main electrodes of the multipolar jack which are disposed inside the body, three of the main electrodes are formed by three main electrodes which are disposed inside the body main portion, and a remaining one of the main electrodes is formed by one main electrode which protrudes inside the cylindrical portion through an opening that is formed in a cylindrical wall of the cylindrical portion. According to this configuration, it is possible to obtain a six-electrode multipolar jack which can be easily miniaturized.

The multipolar plug P of the present invention has: a shaft; and a plurality of main electrodes which are longitudinally arranged on the shaft, and which are to be electrically connected to a plurality of main electrodes of a multipolar jack, respectively. Such a multipolar plug is known as a single-head multipolar plug.

As described above, in the multipolar jack of the present invention, in the case where two electrodes are added by using the cylindrical portion of the body, miniaturization can be enhanced, although, even when a multipolar plug having an annular electrode in a root portion of a shaft is connected to the jack, a situation where the two additional electrodes are short-circuited by the annular electrode does not occur.

Preferably, the multipolar plug of the present invention comprises: a first annular electrode which is disposed outside a root portion of the shaft; a second annular electrode which is concentrically placed inside and separated from the first annular electrode; a contact which is formed on a side of an inner face of the first annular electrode, and which is to be in contact with a contact of a first additional electrode of the jack; and a contact which is formed on a side of an inner face of the second annular electrode in a position shifted in an axial direction of the shaft with respect to the contact of the first annular electrode, and which is to be in contact with a contact of a second additional electrode of the jack.

In the multipolar plug of the present invention, preferably, the first annular electrode has an inner periphery diameter that allows the first annular electrode to be fitted onto the large-diameter portion of the multipolar jack, the second annular electrode has an inner periphery diameter that allows the second annular electrode to be fitted onto the small-diameter portion of the multipolar jack and not to be fitted onto the large-diameter portion, and a fitting distance of the second annular electrode with respect to the small-diameter portion of the multipolar jack is shorter than an axial length of the small-diameter portion of the multipolar jack.

According to this configuration, when the multipolar plug is connected to the multipolar jack, a situation where the second annular electrode of the multipolar plug is in contact with the first additional electrode of the multipolar jack never occurs, and hence a situation does not occur where the two or first and second additional electrodes of the multipolar jack are in contact with the second annular electrode of the multipolar plug and the additional electrodes are short-circuited.

In the multipolar plug of the present invention, preferably, the first and second annular electrodes are electrically insulated from each other by an interelectrode resin molded member which is interposed between the electrodes, and an end face of the interelectrode resin molded member is positioned in a place where the end face does not forward protrude from a front end of the second annular electrode.

In the multipolar plug of the present invention, a configuration can be employed in which four electrodes are formed by the plurality of main electrodes disposed on the shaft, and other two electrodes are formed by the first and second annular electrodes.

As described above, in the multipolar plug of the present invention, miniaturization can be easily enhanced, although two electrodes are added in the periphery of the root portion of the shaft.

The structure for connecting a multipolar jack with a multipolar plug of the present invention comprises: a multipolar jack body in which a plurality of main electrodes are longitudinally arranged inside the body; a body main portion which is formed integrally with the multipolar jack body; a cylindrical portion which forward protrudes from the body main portion; a shaft of a single-head multipolar plug which is inserted through the cylindrical portion to a position concentrical with or substantially concentrical with the cylindrical portion; a plurality of main electrodes which are longitudinally arranged on the shaft, and which are electrically connected to the plurality of main electrodes of the multipolar jack body, respectively; a large-diameter portion which is on a side of a basal portion forming the cylindrical portion; a small-diameter portion which protrudes from a front end of the large-diameter portion; a step which is stepwise formed in a boundary between the large-diameter portion and the small-diameter portion; a contact of a first additional electrode which is placed outside the large-diameter portion, and which is to be in contact in rear of the step with a contact on a side of an inner face of a first annular electrode disposed in a periphery of the shaft of the multipolar plug; and a contact of a second additional electrode which is placed outside the small-diameter portion, and which is to be in contact in front of the step with a contact on a side of an inner face of a second annular electrode concentrically disposed inside the first annular electrode.

In the connecting structure, a configuration can be employed in which a number of the main electrodes of the multipolar jack is four, and a number of the main electrodes of the multipolar plug is four.

In the connecting structure, preferably, a tip end of the first additional electrode is positioned in the rear of the step. Preferably, the first annular electrode has an inner periphery diameter that allows the first annular electrode to be fitted onto the large-diameter portion of the multipolar jack, the second annular electrode has an inner periphery diameter that allows the second annular electrode to be fitted onto the small-diameter portion of the multipolar jack and not to be fitted onto the large-diameter portion, and a fitting distance of the second annular electrode with respect to the small-diameter portion of the multipolar jack is shorter than an axial length of the small-diameter portion of the multipolar jack.

According to this connecting structure, when the multipolar plug is connected to the multipolar jack, a situation where the second annular electrode of the multipolar plug is in contact with the first additional electrode of the multipolar jack never occurs, and hence a situation where the two or first and second additional electrodes of the multipolar jack are in contact with the second annular electrode of the multipolar plug and the additional electrodes are short-circuited does not occur.

As described above, according to the structure for connecting a multipolar jack with a multipolar plug of the present invention, a multipolar jack and a multipolar plug can be connected to each other in a compact shape, and miniaturization can be enhanced, although a situation where the two additional electrodes of the multipolar jack are short-circuited by the annular electrode of the multipolar plug does not occur.

DETAILED DESCRIPTION OF THE PREFERRED EMBODIMENT

An embodiment of a multipolar jack J according to the present invention will be described with reference to FIGS. 1 to 4.

Figure 1:
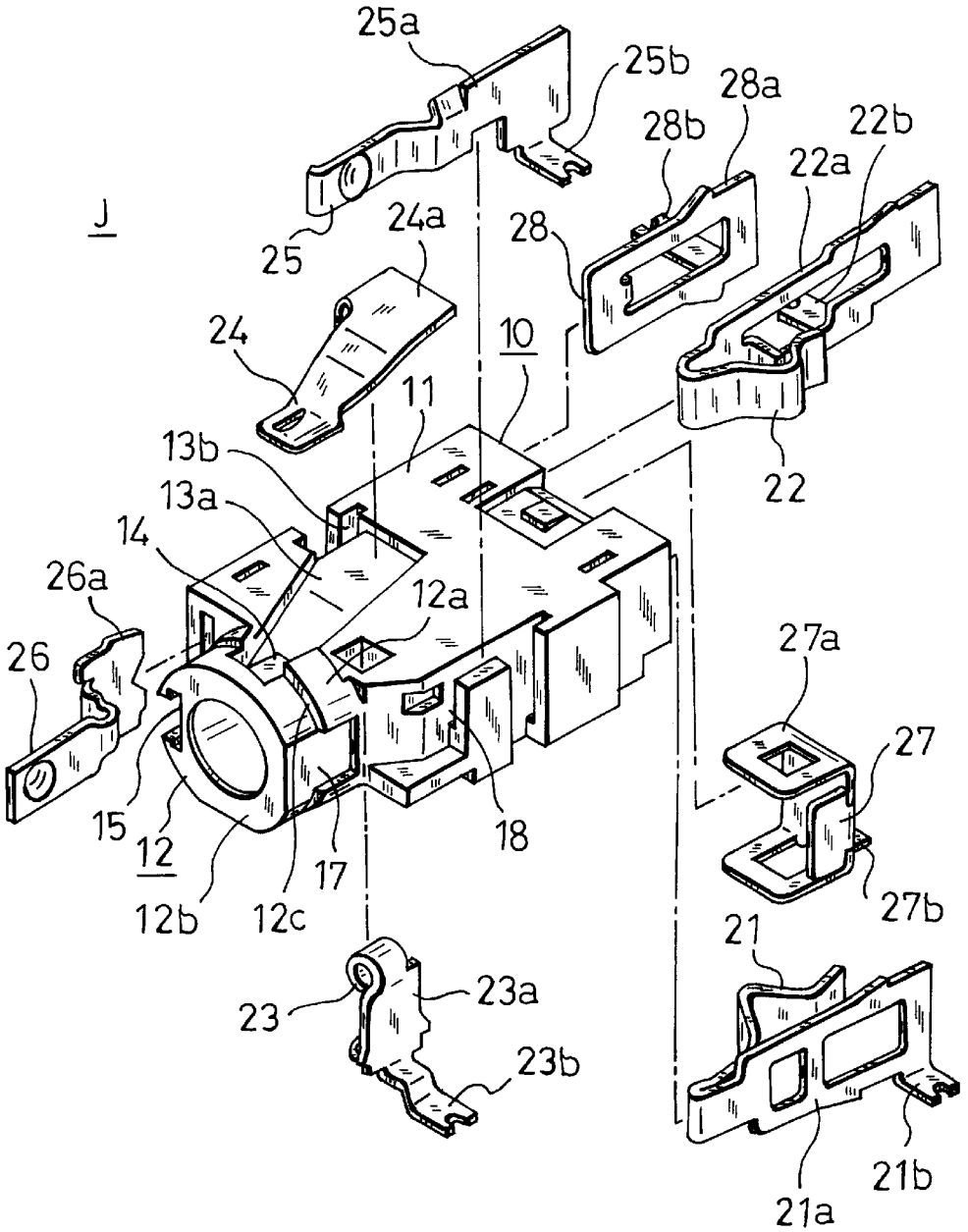
FIG. 1 is an exploded perspective view of a multipolar jack of an embodiment of the present invention.
Figure 2:
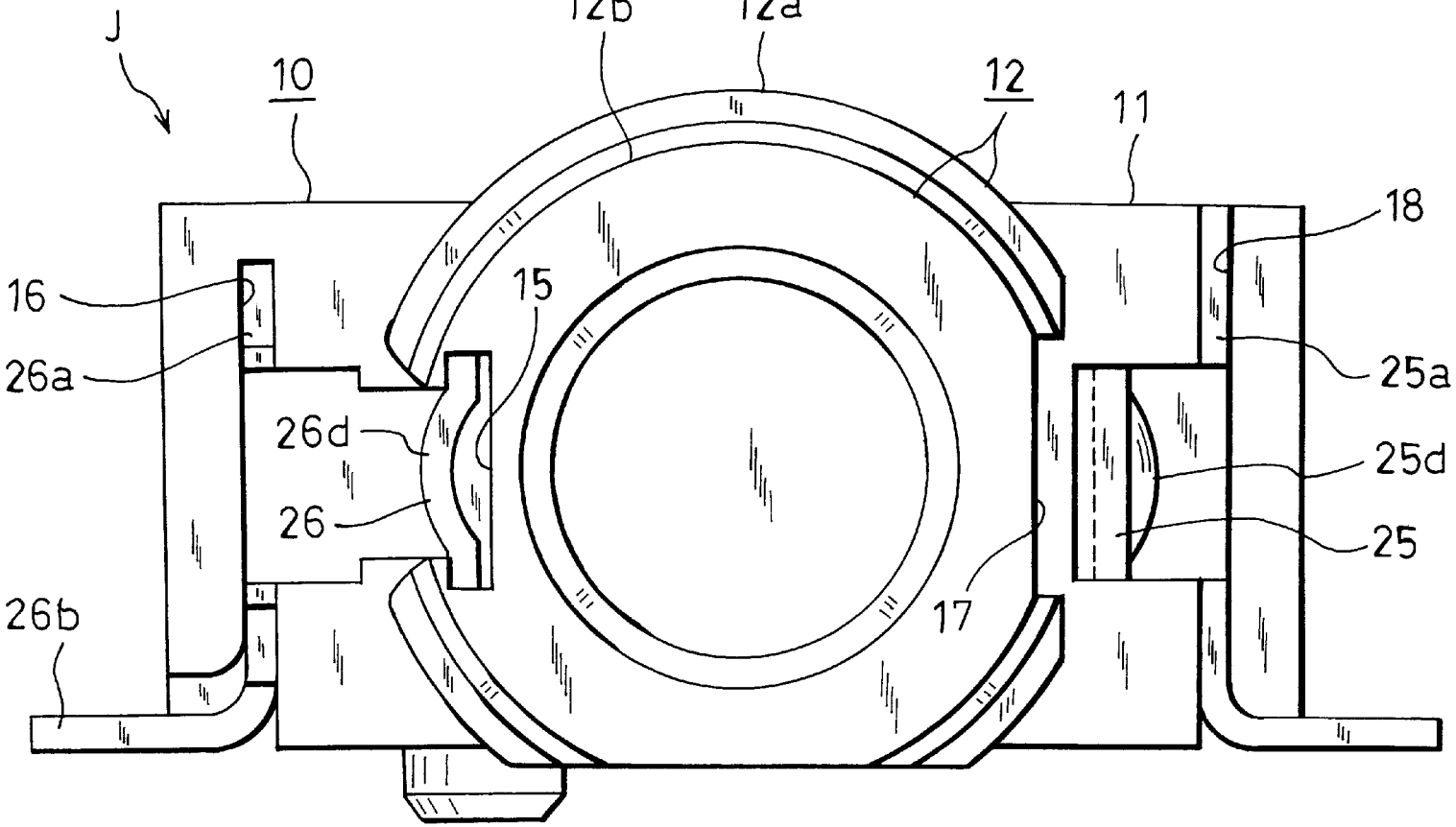
FIG. 2 is a front view of the multipolar jack.
Figure 3:
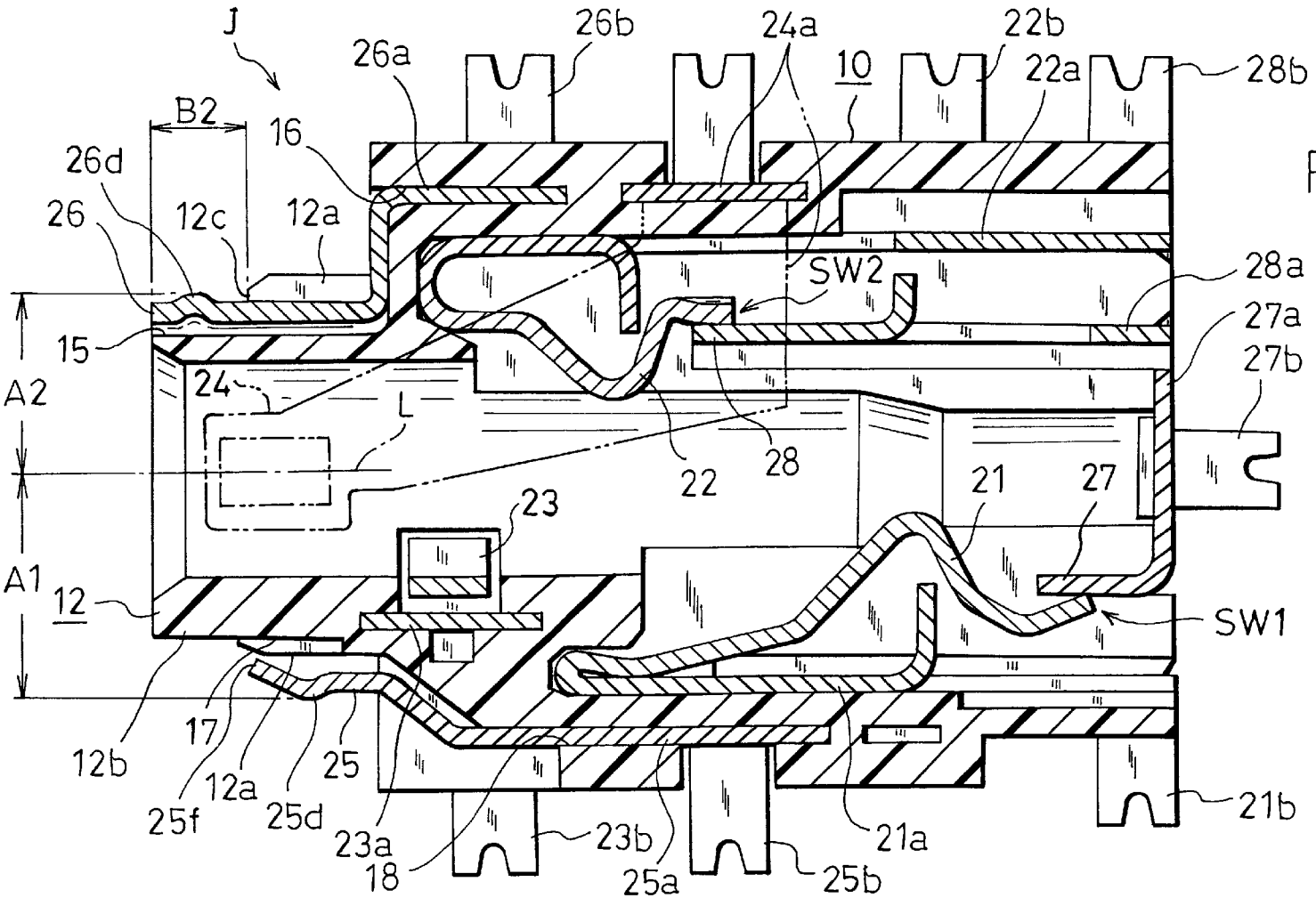
FIG. 3 is a cross section plan view of the multipolar jack.

FIG. 1 is an exploded perspective view of the multipolar jack J, FIG. 2 is a front view of the multipolar jack, and FIG. 3 is a cross section plan view of the multipolar jack.

The multipolar jack has the body 10 which is an integrally molded member of a synthetic resin having excellent electrical insulating properties. The body 10 has integrally a body main portion 11, and a cylindrical portion 12 which protrudes outwardly or forwardly from the body main portion 11. The body main portion 11 has a rectangular parallelepiped outer shape which extends to both lateral sides of the cylindrical portion 12. The multipolar jack J comprises six electrodes. In FIG. 1, these electrodes are denoted by reference numerals 21 to 26. In the following description, these electrodes are simply referred to as the first electrode 21, the second electrode 22, the third electrode 23, the fourth electrode 24, the fifth electrode 25, and the sixth electrode 26.

The four or first to fourth electrodes 21 to 24 form four main electrodes as a whole. As shown in FIG. 1, among the electrodes, the first and second electrodes 21 and 22 are inserted into the body 10 from a rear end opening of the body main portion 11. The third electrode 23 is inserted into the body 10 from a lower side (lower face side) of the body main portion 11 as shown in FIG. 1, and then attached thereto as shown in FIG. 3. Attachment pieces 21*a*, 22*a*, and 23*a* which are respectively disposed continuously with the first, second, and third electrodes 21, 22, and 23 are immovably fixed to predetermined places of the body main portion 11, and the first, second, and third electrodes 21, 22, and 23 are arranged in this sequence, inside the body 10 and in a direction from the rear side toward the front side. Soldering terminals 21*b*, 22*b*, and 23*b* which are respectively formed on the first, second, and third electrodes 21, 22, and 23 outward protrude from the lower end of the body main portion 11 to an outward lateral side. The first and second electrodes 21 and 22 are respectively paired with electrodes 27 and 28, so that the one movable or first electrode 21 and the stationary electrode 27 form a first normally close switch SW1, and the other movable or second electrode 22 and the stationary electrode 28 form a second normally close switch SW2. Similarly, attachment pieces 27*a* and 28*a*, and soldering terminals 27*b* and 28*b* are respectively disposed continuously with the electrodes 27 and 28. The attachment pieces 27*a* and 28*a* are immovably fixed to predetermined places inside the body main portion 11, and the soldering terminals 27*b* and 28*b* protrude to an outward lateral side or rearward from the lower end of the body main portion 11. As seen from FIG. 1, an attachment piece 24*a* of the fourth electrode 24 is attached to the outer side of the body main portion 11 in a state where the piece is housed in an upper-face recess 13*a* and a vertical groove 13*b* of the body main portion 11. The fourth electrode 24 protrudes inside the cylindrical portion 12 through an opening 14 which is formed in a cylindrical wall of the cylindrical portion 12.

The two or fifth and sixth electrodes 25 and 26 form additional electrodes. In the following description, the fifth electrode 25 is defined as a first additional electrode, and the sixth electrode 26 as a second additional electrode. The two additional electrodes are respectively placed in two places in the periphery of the cylindrical portion 12 by using the cylindrical portion 12.

The cylindrical portion 12 is formed by a large-diameter portion 12*a* which is on a side of the basal portion, and a small-diameter portion 12*b* which protrudes from the front end of the large-diameter portion 12*a*. A step 12*c* is stepwise formed in the boundary between the large-diameter portion 12*a* and the small-diameter portion 12*b*. The fifth electrode 25 which is the first additional electrode is placed outside the large-diameter portion 12*a*, and the sixth electrode 26 which is the second additional electrode is placed outside the small-diameter portion 12*b*.

As shown in FIG. 2, the fifth electrode 25 is configured as an elastic movable electrode which is opposed via a small gap to a flat face 17 that is formed by removing (performing a so-called D-cut on) a right portion of the outer periphery of the cylindrical portion 12. As shown in FIG. 1 or 3, the fifth electrode 25 comprises an attachment piece 25*a* which protrudes rearwardly, and a soldering terminal 25*b*. The attachment piece 25*a* is insertingly fixed to an attachment groove 18 of the body main portion 11 on the right side of the cylindrical portion 12, thereby enabling the fifth electrode 25 to be elastically displaced in a direction along which the electrode 25 approaches and separates from the cylindrical portion 12. The soldering terminal 25*b* protrudes to an outward lateral side from the lower end of the body main portion 11. On the other hand, the sixth electrode 26 is housed in a recess 15 which is formed in the left side of the outer periphery of the cylindrical portion 12. As shown in FIG. 1 or 3, also the sixth electrode 26 comprises an attachment piece 26*a* which rearward protrudes, and a soldering terminal 26*b*. The attachment piece 26*a* is insertingly fixed to an attachment groove 16 of the body main portion 11 on the left side of the cylindrical portion 12. The soldering terminal 26*b* which is disposed continuously with the attachment piece 26*a* protrudes to an outward lateral side from the lower end of the body main portion 11.

The distance A1 from the axis L of the cylindrical portion 12 shown in FIG. 3 to a contact of the fifth electrode 25 is longer than the distance A2 from the axis of the cylindrical portion 12 to a contact 26*d* of the sixth electrode 26. The contact 25*d* of the fifth electrode 25 is positioned in rear of the step 12*c*, and the contact 26*d* of the sixth electrode 26 is positioned in front of the step 12*c*. The tip end 25*f* of the fifth electrode 25 is positioned in rear of the step 12*c*. According to this configuration, even when a multipolar plug (not shown) in which a regular circular annular electrode is disposed in a root portion of the shaft is connected to the jack, a situation where the fifth and sixth electrodes 25 and 26 are in contact with the annular electrode to be short-circuited does not occur. Specifically, when the regular circular annular electrode of the multipolar plug is fitted onto the outer side of the large-diameter portion 12*a* of the cylindrical portion 12, only the fifth electrode 25 is in contact with the annular electrode, and the sixth electrode 26 is not in contact therewith. In the case where the annular electrode of the multipolar plug has an inner periphery diameter that allows the annular electrode to be fitted onto the small-diameter portion 12*b* of the cylindrical portion 12 and not to be fitted onto the large-diameter portion 12*a*, the annular electrode is fitted onto only the small-diameter portion 12*b* to be in contact with the sixth electrode 26 and not to be in contact with the fifth electrode 25. Namely, the annular electrode abuts against the step 12*c*, and hence is never fitted onto the large-diameter portion 12*a* to be in contact with the fifth electrode 25 or the tip end 25*f* of the fifth electrode 25. Therefore, a situation where both the fifth and sixth electrodes 25 and 26 are in contact with the regular circular annular electrode to be short-circuited does not occur.

As described above, the sixth electrode 26 is housed in the recess 15 of the outer periphery of the cylindrical portion 12 to be within the range of the thickness of the cylindrical portion 12. Therefore, the sixth electrode 26 does not protrude outside the cylindrical portion 12. Furthermore, since the fifth electrode 25 is placed in close proximity to the flat face 17 which is formed by D-cutting the cylindrical portion 12, the fifth electrode 25 is not positioned in a place which is largely separated from the cylindrical portion 12. For these reasons, the fifth and sixth electrodes 25 and 26 are substantially housed in the space formed by the cylindrical portion in the case where the cylindrical portion 12 is assumed to be regular circular, and hence a situation where the fifth and sixth electrodes 25 and 26 occupy the space outside the cylindrical portion 12 and the size of the multipolar jack J is increased does not arise.

The attachment piece 26*a* of the sixth electrode 26 is insertingly fixed to the attachment groove 16 of the body main portion 11 on the left side of the cylindrical portion 12, and the attachment piece 25*a* of the fifth electrode 25 is insertingly fixed to the attachment groove 18 of the body main portion 11 on the right side of the cylindrical portion 12, thereby producing an advantage that a situation where places to which the fifth and sixth electrodes 25 and 26 are attached protrude outside the body 10 does not occur, and the size of the multipolar jack is prevented from being increased.

Figure 4:
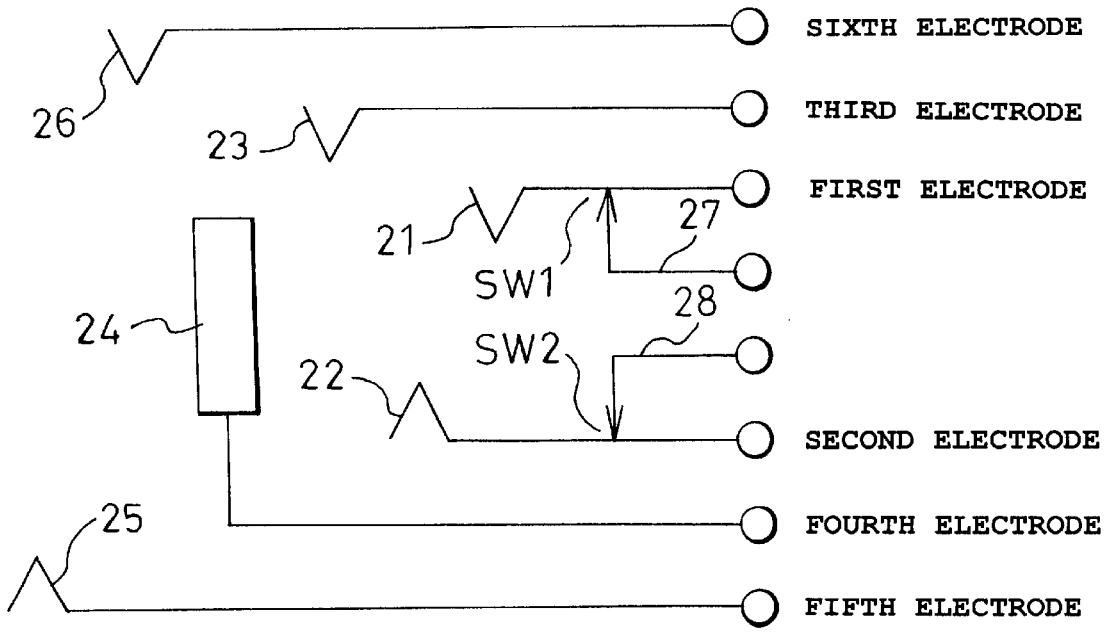
FIG. 4 is a diagram of a circuit pattern.

In the multipolar jack J, the first to sixth electrodes form the circuit pattern shown in FIG. 4.

Next, an embodiment of the multipolar plug P according to the present invention will be described with reference to FIGS. 5 and 6.

Figure 5:
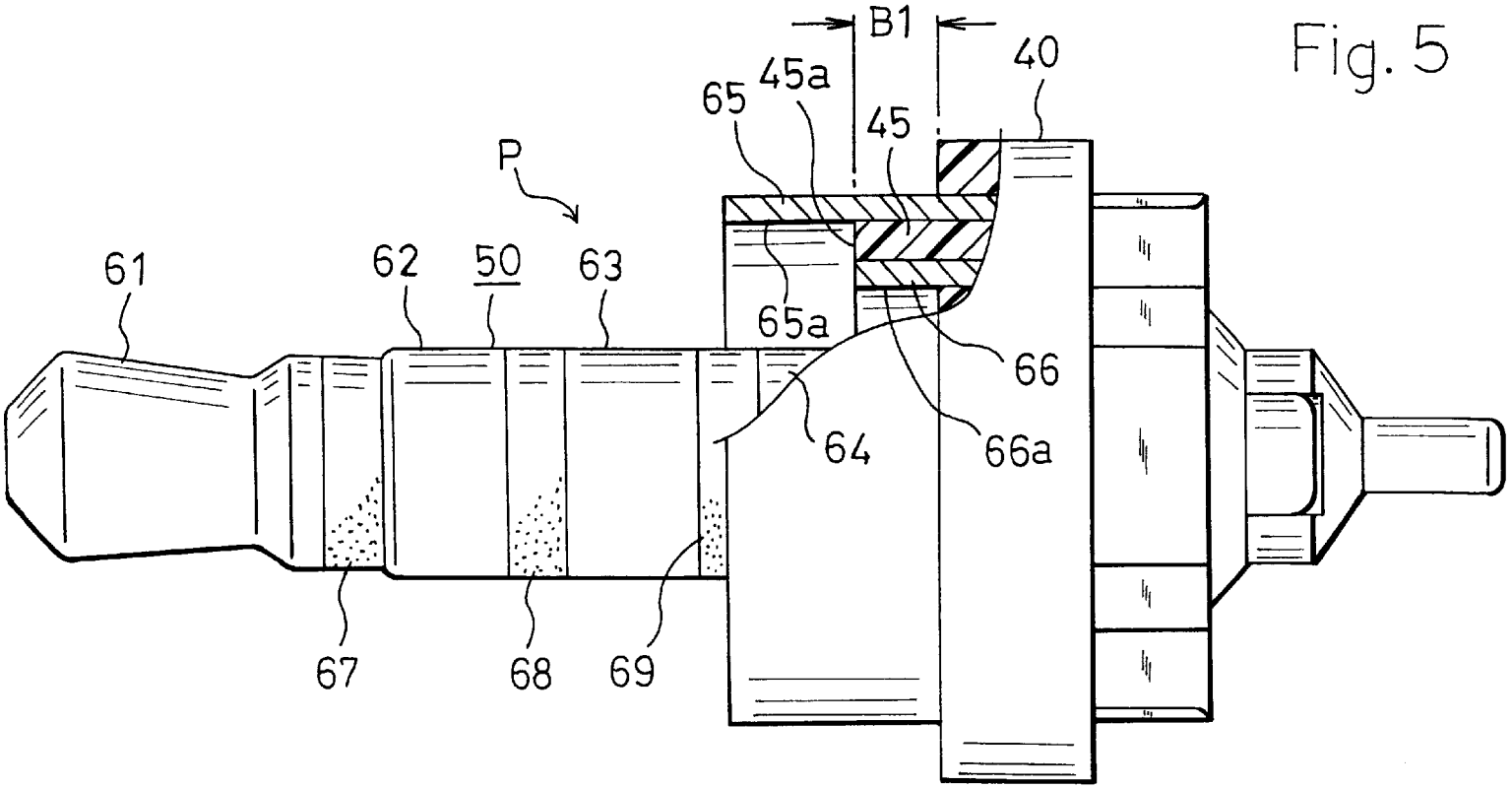
FIG. 5 is a side view of a multipolar plug of an embodiment of the invention.
Figure 6:
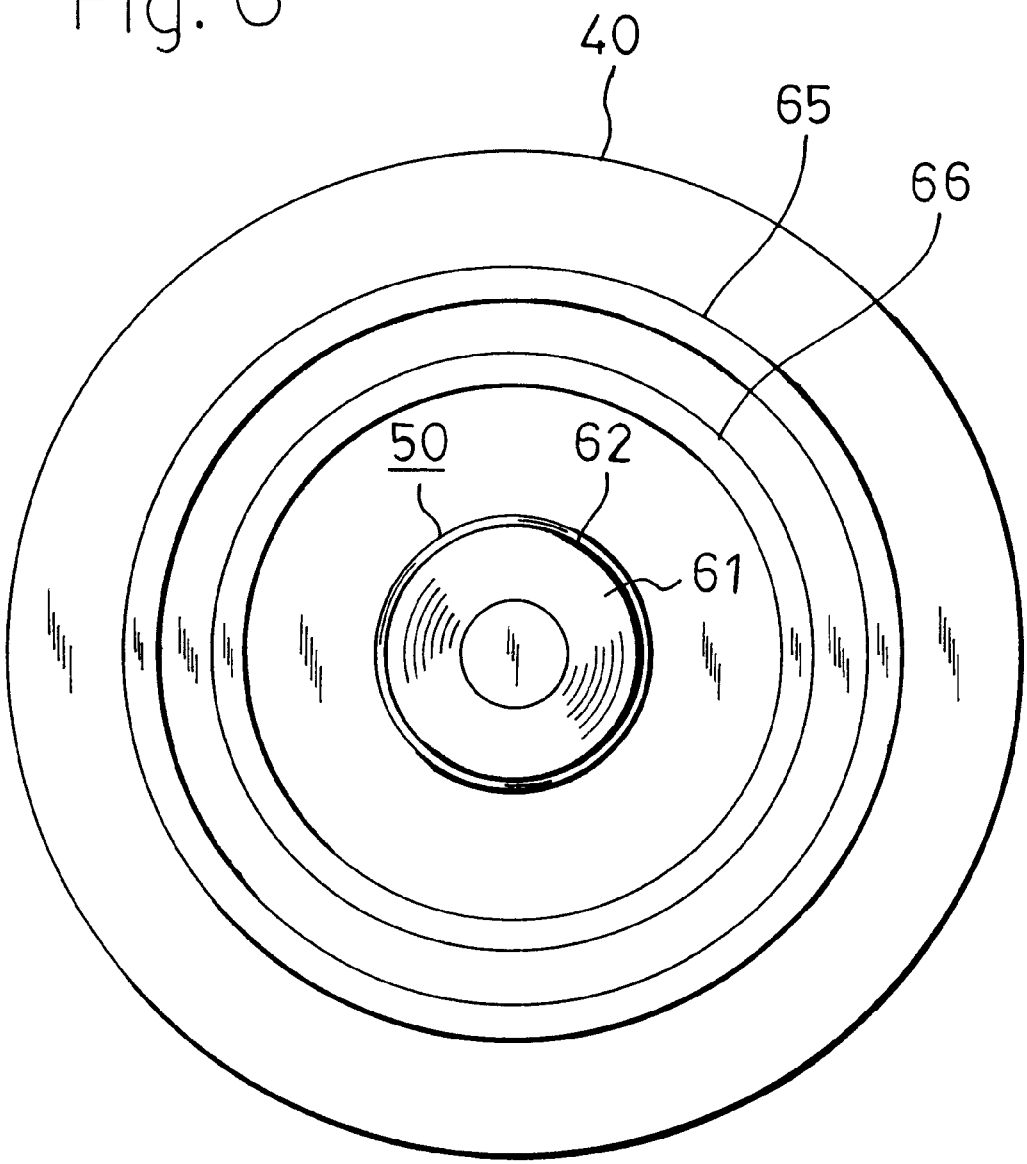
FIG. 6 is a front view of the multipolar plug.

FIG. 5 is a partially cutaway side view of the multipolar plug P, and FIG. 6 is a front view of the multipolar plug. The multipolar plug P is a single-head multipolar plug, and has a circular basal portion 40 which is molded by a synthetic resin having excellent electrical insulating properties. The multipolar plug P comprises six electrodes. In FIG. 5, these electrodes are denoted by reference numerals 61 to 66. In the following description, these electrodes are simply referred to as the first electrode (tip electrode) 61, the second electrode 62, the third electrode 63, the fourth electrode 64, the fifth electrode 65, and the sixth electrode 66.

The four or first to fourth electrodes 61 to 64 form four main electrodes as a whole. These electrodes are arranged in this sequence on a shaft 50 which straightly protrudes from the basal portion 40, in a direction from the tip end side toward the root portion. Spacers 67, 68, and 69 formed by an insulator are interposed between the electrodes.

A first annular electrode which forms the fifth electrode 65, and a second annular electrode which forms the sixth electrode 66 placed concentrically inside the fifth electrode 65 with separation therefrom are disposed outside the fourth electrode 64 placed in a root portion of the shaft 50. A contact 65*a* formed on the inner face of the fifth electrode 65, and a contact 66*a* formed on the inner face of the sixth electrode 66 are positionally shifted from each other in the axial direction of the shaft 50. The fifth and sixth electrodes 65 and 66 are electrically insulated from each other by an interelectrode resin molded member 45 which is interposed between the electrodes. In the illustrated example, an end face 45*a* of the interelectrode resin molded member 45 is placed in the same position in the longitudinal direction as the front end of the sixth electrode 66. Alternatively, the end face 45*a* of the interelectrode resin molded member 45 may be positioned behind the front end of the sixth electrode 66, or namely the sixth electrode 66 may protrude from the end face 45*a* of the interelectrode resin molded member 45.

In the multipolar plug P, the fifth electrode 65 has an inner periphery diameter that allows the electrode to be fitted onto the large-diameter portion 12*a* of the multipolar jack J which has been described with reference to FIG. 3 and the like, and the sixth electrode 66 has an inner periphery diameter that allows the electrode to be fitted onto the small-diameter portion 12*b* of the multipolar jack J and not to be fitted onto the large-diameter portion 12*a*. The fitting distance of the sixth electrode 66 with respect to the small-diameter portion 12*b* of the multipolar jack J is shorter than the axial length of the small-diameter portion 12*b* of the multipolar jack J. In the embodiment, the fitting distance of the sixth electrode 66 with respect to the small-diameter portion 12*b* of the multipolar jack J is defined by the protruding length B1 of the sixth electrode 66 from the end face of the basal portion 40, and the protruding length B1 is shorter than the protruding length B2 of the small-diameter portion 12*b* from the step 12*c* shown in FIG. 3 (B1<B2).

Figure 7:
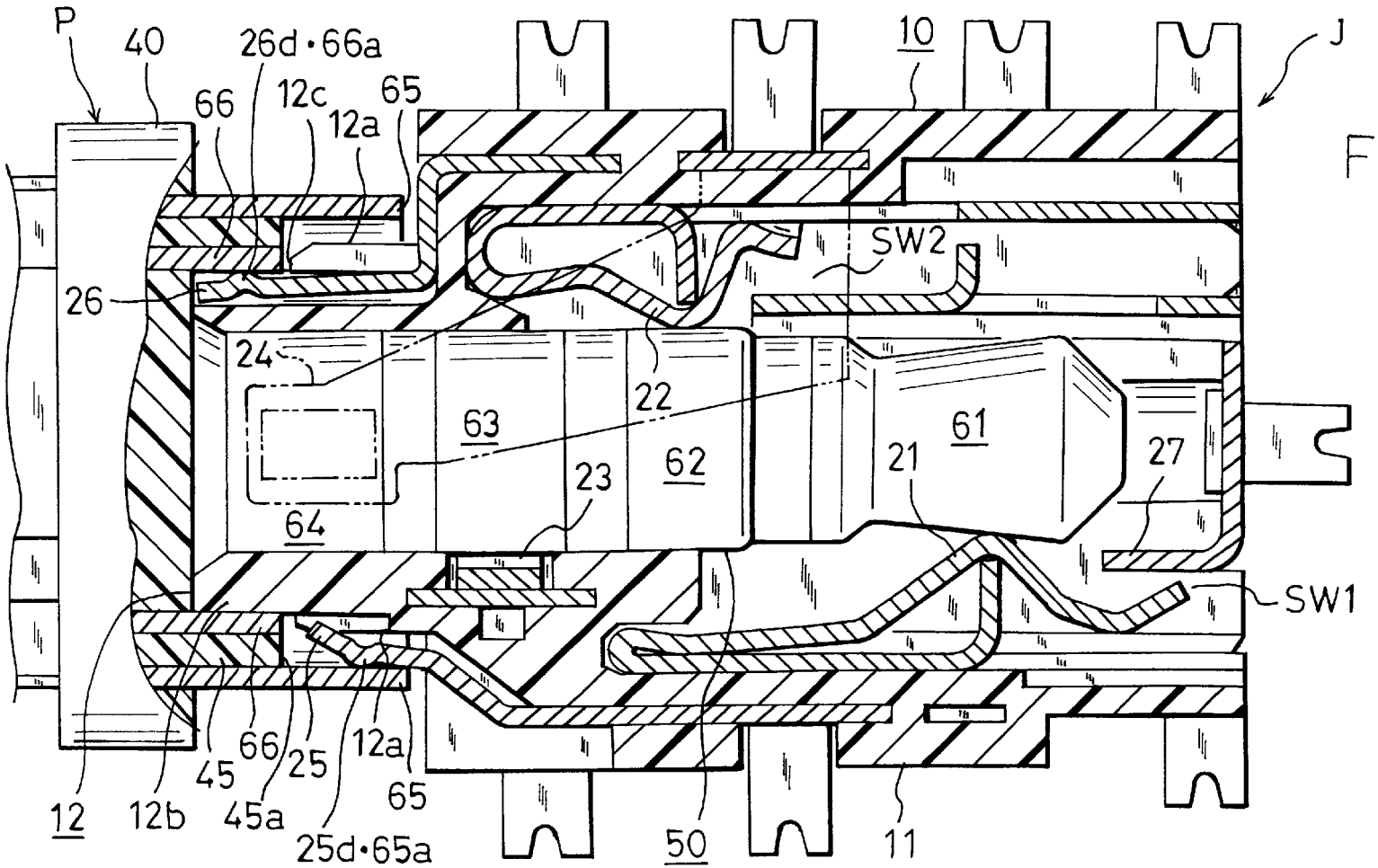
FIG. 7 is a cross section plan view of a structure for connecting a multipolar jack with a multipolar plug in an embodiment of the invention.

Next, an embodiment of the structure for connecting the multipolar jack J with the multipolar plug P according to the invention will be described with reference to FIG. 7.

In this connecting structure, the multipolar jack J which has been described with reference to FIGS. 1 to 4, and the single-head multipolar plug P which has been described with reference to FIGS. 5 and 6 are combined with each other. Namely, when the shaft 50 of the multipolar plug P is inserted through the cylindrical portion 12 of the multipolar jack J to a position concentrical with or substantially concentrical with the cylindrical portion 12, the first to fourth electrodes 61 to 64 which are the main electrodes of the multipolar plug P are respectively in elastic contact with the first to fourth electrodes 21 to 24 which are the main electrodes of the multipolar jack J, as shown in FIG. 7. Under this state, the first and second electrodes 21 and 22 of the multipolar jack J are outward elastically deformed, and hence the first and second normally close switches SW1 and SW2 of the multipolar jack J are opened. The contact 65*a* of the fifth electrode 65 of the multipolar plug P is in contact with the contact 25*d* of the fifth electrode 25 which is the movable electrode of the multipolar jack J. By contrast, the contact 66*a* of the sixth electrode 66 of the multipolar plug P is in contact with the contact 26*d* of the sixth electrode 26 of the multipolar jack J. Therefore, a six-electrode connecting structure is obtained as a whole.

In this connecting structure, as described with reference with FIGS. 3 and 5, the fitting distance (B1) of the sixth electrode 66 with respect to the small-diameter portion 12*b* of the multipolar jack J is shorter than the axial length (B2) of the small-diameter portion 12*b* of the small-diameter portion 12*b* of the multipolar jack J. The tip end 25*f* of the fifth electrode 25 is positioned in the rear of the step 12*c*. Therefore, a situation where the sixth electrode 66 of the multipolar plug P is in contact with the sixth electrode 26 of the multipolar jack J and also is in contact with the fifth electrode 25 of the multipolar jack J does not occur, thereby eliminating a chance that the fifth and sixth electrodes 25 and 26 of the multipolar jack J are accidentally short-circuited by the sixth electrode 66 of the multipolar plug P.

As shown in FIG. 3, the sixth and fifth electrodes 26 and 25 of the multipolar jack J are placed in positions which protrude forwardly from the front end of the body main portion 11 by a relatively long distance. According to this configuration, before the first electrode 61 which is the tip electrode of the multipolar plug P inserted into the body 10 becomes in contact with the first electrode 21 of the multipolar jack J that is positioned in the inward rearmost place, the sixth or fifth electrode 26 or 25 of the multipolar jack J is in contact with the sixth or fifth electrode 66 or 65 of the multipolar plug P. When the contact timings of the fifth electrodes 25 and 65, and the sixth electrodes 26 and 66 in the case where the multipolar jack J and the multipolar plug P are connected to each other are set to be earlier than that of the first electrodes 21 and 61 as described above, the fifth or sixth electrode 25 or 26 which is added by using the cylindrical portion 12 can be used as an electrode for recognizing the stereo mode or the monaural mode in an audio apparatus. According to this configuration, before such a mode is recognized, the first electrode 61 of the multipolar plug P can be prevented from being in contact with the first electrode 21 of the multipolar jack J to receive an audio signal.

In the multipolar jack J and the multipolar plug P which have been described above, four electrodes are formed by the main electrodes, and two electrodes are formed by the additional electrodes, whereby six electrodes are formed as a whole. The number of electrodes which are formed by the main electrodes is not restricted to four, and may be, for example, two or three.

The entire disclosure of Japanese Patent Application No. 2000-330159 filed on Oct. 30, 2000 including specification, claims, drawings, and summary are incorporated herein by reference in its entirety.

What is claimed is:

1. A multipolar jack having:

a body;

a body main portion which is formed integrally with said body; a cylindrical portion which protrudes forwardly from said body main portion;

a multipolar plug defining a shaft and a plurality of main electrodes longitudinally arranged on said shaft;

a plurality of main electrodes which are disposed inside said body, electrical connection to said plurality of main electrodes of said multipolar plug, respectively, said multipolar plug being insertable through said cylindrical portion to a position concentrical with or substantially concentrical with said cylindrical portion, said multipolar jack, comprising:

a large-diameter portion which is on a side of a basal portion forming said cylindrical portion; a small-diameter portion which protrudes from a front end of said large-diameter portion; a step which is stepwise formed in a boundary between said large-diameter portion and said small-diameter portion;

a first additional electrode which is placed outside said large-diameter portion, and in which a contact is positioned in the rear of said step to be in contact with a contact on a side of an inner face of a first annular electrode disposed in a periphery of said shaft of said multipolar plug; and a second additional electrode placed outside said small-diameter portion, and in which a contact is positioned in front of said step to be in contact with a contact on a side of an inner face of a second annular electrode concentrically disposed in a periphery of said shaft of said multipolar plug and inside said first annular electrode.

2. A multipolar jack according to claim 1, wherein a tip end of said first additional electrode is positioned in the rear of said step.

3. A multipolar jack according to claim 1, wherein a tip end of said first additional electrode is positioned in the rear of said step.

4. A multipolar jack according to claim 1, wherein the diameter of an outer periphery of said large-diameter portion is shorter than said diameter of said inner periphery of said first annular electrode of said multipolar plug and larger than said diameter of said inner periphery of said second annular electrode, and wherein the diameter of said outer periphery of said small-diameter portion is shorter than said diameter of said inner periphery of said second annular electrode.

5. A multipolar jack according to claim 1, wherein said body main portion has a rectangular parallelepiped outer shape which extends to both lateral sides of said cylindrical portion, said first and second additional electrodes being placed on lateral sides of said cylindrical portion, respectively, and wherein a first additional electrode attachment piece which is formed by rearward elongation of said second additional electrode are fixed in both sides of said cylindrical portion to said body main potion.

6. A multipolar jack according to claim 1, wherein four electrodes are formed by said plurality of main electrodes of said multipolar jack which are disposed inside said body, three of said main electrodes are formed by three main electrodes which are disposed inside said body main portion, and a remaining one of said main electrodes is formed by one main electrode which protrudes inside said cylindrical portion through an opening that is formed in a cylindrical wall of said cylindrical portion.

7. A structure for connecting a multipolar jack with a multipolar plug, comprising:

a multipolar jack body in which a plurality of main electrodes are longitudinally arranged inside said multipolar jack body;

a body main portion which is formed integrally with said multipolar jack body, a cylindrical portion protruding forwardly from said body main portion;

a shaft of a single-head multipolar plug insertable through said cylindrical portion to a position concentrical with or substantially concentrical with said cylindrical portion;

a plurality of main electrodes which are longitudinally arranged on said shaft, and which are electrically connected to said plurality of main electrodes of said multipolar jack body, respectively;

a large-diameter portion which is on a side of a basal portion forming said cylindrical portion;

a small-diameter portion which protrudes from a front end of said large-diameter portion;

a step which is stepwise formed in a boundary between said large-diameter portion and said small-diameter portion;

a contact of a first additional electrode which is placed outside said large-diameter portion, and which is to be in contact in the rear of said step with a contact on a side of an inner face of a first annular electrode disposed in a periphery of said shaft of said multipolar plug; and a contact of a second additional electrode which is placed outside said small-diameter portion, and which is in contact in front of said step with a contact on a side of an inner face of a second annular electrode concentrically disposed inside said first annular electrode.

8. A structure for connecting a multipolar jack with a multipolar plug according to claim 7, wherein a tip end of said first additional electrode is positioned in the rear of said step.

9. A structure for connecting a multipolar jack with a multipolar plug according to claim 7, wherein said first annular electrode has an inner periphery diameter that allows said first annular electrode to be fitted onto said large-diameter portion of said multipolar jack, said second annular electrode has an inner periphery diameter that allows said second annular electrode to be fitted onto said small-diameter portion of said multipolar jack and not to be fitted onto said large-diameter portion, and wherein the fitting distance of said second annular electrode with respect to said small-diameter portion of said multipolar jack is shorter than an axial length of said small-diameter portion of said multipolar jack.

10. A structure for connecting a multipolar jack with a multipolar plug, according to claim 7, wherein a number of said main electrodes of said multipolar jack is four, and a number of said main electrodes of said multipolar plug is four.

11. A multipolar plug having:

a shaft;

a plurality of main electrodes which are longitudinally arranged on said shaft, and which are to be electrically connected to a plurality of main electrodes of a multipolar jack, respectively;

a first annular electrode which is disposed outside a root portion of said shaft;

a second annular electrode which is concentrically placed inside and separated from said first annular electrode;

a contact which is formed on a side of an inner face of said first annular electrode, and which is to contact a contact of a first additional electrode of said jack; and a contact which is formed on a side of an inner face of said second annular electrode in a position shifted in an axial direction of said shaft with respect to said contact of said first annular electrode, and which is to contact a contact of a second additional electrode of said jack, wherein the multipolar jack is used as a counter jack, said multipolar jack integrally having: a body main portion; and a cylindrical portion which protrudes forwardly from said body main portion; a cylindrical portion being formed by a large-diameter portion which is on a side of a basal portion, and a small-diameter portion which protrudes from a front end of said large-diameter portion; a step being stepwise formed in a boundary between said large-diameter portion and said small-diameter portion; a first additional electrode being placed outside said large-diameter portion; a second additional electrode being placed outside said small-diameter portion; a tip end of said first additional electrode being positioned in the rear of said step, said first annular electrode has an inner diameter periphery that allows said first annular electrode to be fitted onto said large-diameter portion of said multipolar jack, said second annular electrode has an inner diameter periphery that allows said second annular electrode to be fitted onto said small-diameter portion of said multipolar jack and not to be fitted onto said large-diameter portion; and a fitting distance of said second annular electrode with respect to said small-diameter portion of said multipolar jack is shorter than an axial length of said small-diameter portion of said multipolar jack.

12. A multipolar plug according to claim 1, further comprising:

an interelectrode resin molded member, wherein said first and second annular electrodes are electrically insulated from each other by said interelectrode resin molded member which is interposed between said electrodes, and an end face of said interelectrode resin molded member is positioned in a place where said end face does not forward protrude from a front end of said second annular electrode.

13. A multipolar plug according to claim 11, wherein four electrodes are formed by said plurality of main electrodes disposed on said shaft, and said other two electrodes are formed by said first and second annular electrodes.

* * * * *